United States Patent [19]

Reese et al.

[11] 4,403,744

[45] Sep. 13, 1983

[54] METHOD AND APPARATUS FOR CONTROLLING STRAND TENSION DURING WINDING

[75] Inventors: Walter J. Reese, North Huntington, Pa.; Jimmy D. Walker, Shelby, N.C.

[73] Assignee: PPG Industries, Inc., Pittsburgh, Pa.

[21] Appl. No.: 297,603

[22] Filed: Aug. 31, 1981

[51] Int. Cl.[3] ..... B65H 54/02

[52] U.S. Cl. ..... 242/18 G; 242/43 R; 242/43.2; 242/45; 242/155 R

[58] Field of Search ..... 242/18 G, 18 R, 45, 242/43 R, 43.2, 147 R, 151, 155 R

[56] References Cited

U.S. PATENT DOCUMENTS

| | | | |
|---|---|---|---|
| 1,042,451 | 10/1912 | Knight | 242/151 X |
| 1,595,818 | 8/1926 | Bliss | 242/45 X |
| 1,990,620 | 2/1935 | Schweiter | 242/43 |
| 2,219,020 | 10/1940 | Reiners et al. | 242/27 |
| 2,570,617 | 10/1951 | Wentz | 242/151 |
| 2,656,126 | 10/1953 | Kingsbury et al. | 242/45 |
| 2,764,367 | 9/1956 | Brey | 242/45 X |
| 2,859,918 | 11/1958 | Furst | 242/27 |
| 2,969,196 | 1/1961 | Kupper | 242/27 |
| 3,112,897 | 12/1963 | Eshbaugh et al. | 242/45 |
| 3,114,511 | 12/1963 | Geen | 242/18 G X |
| 3,151,963 | 10/1964 | Cochran | 242/18 G X |
| 3,169,714 | 2/1965 | Schippers | 242/18 R |
| 3,188,013 | 6/1965 | Geen | 242/18 G X |
| 3,273,812 | 9/1966 | Lacasse | 242/42 |
| 3,532,478 | 10/1970 | Drummond | 65/2 |
| 3,876,404 | 4/1975 | Drummond | 65/2 |

OTHER PUBLICATIONS

"The Manufacturing Technology of Continuous Glass Fibers" by K. L. Loewenstein, Elsevier Scientific Publishing Company, New York, 1973, pp. 268–272.

*Primary Examiner*—Stanley N. Gilreath
*Attorney, Agent, or Firm*—Kenneth J. Stachel

[57] ABSTRACT

A method and apparatus satisfactorily controls the tension of filamentary material during winding of the material into a layered package. In the method, filamentary strand is conveyed from a source to a rotating contacting means having a drive means to drive the contacting means during the contact in a direction opposite to the direction of movement of the filamentary strand or in a similar direction but at a slower velocity than the direction of movement of the filamentary strand. The filamentary strand during or after contacting the rotating contacting means is moved in a reciprocating traversing movement for collection on a rotating collecting means. The rotating collecting means provides the movement of the strand from the source to the collecting means and collects the strand into a package of strand. The apparatus includes a support having a source for the filamentary material, a rotating contacting means rotatably connected with drive means which is fixedly or movably attached to the support, and the rotating collecting means attached to the support, and a means for moving the rotating contacting means and rotating collecting means relative to each other to traverse the strand in reciprocal motion onto the rotating collection means. The rotating contacting means has an eccentric groove and is located at an effective distance from the rotating collecting means to provide for a throw of the strand across a portion of the length of the rotating collecting means.

23 Claims, 5 Drawing Figures

METHOD AND APPARATUS FOR CONTROLLING STRAND TENSION DURING WINDING

The present invention is directed to a method and apparatus for controlling the tension of filamentary material while the material is being wound.

More particularly, the present invention is directed to a method and apparatus for controlling the tension of one or more strands of filamentary material during rewinding of the one or more strands from one package to another without adding any twists to the strand or strands for the production of yarn.

In the production of strands of filamentary material, it is inevitable at some point in the processing that the material is wound into a package. Sometimes to obtain a desired product, the strands undergo rewinding to produce particular types of packages or products. Such winding can occur during the formation of the filamentary material or in rewinding the filamentary material to produce the product packages. For example, in the manufacture of yarn from strands of continuous glass filaments, it has been the practice in the art to wind the continuous filament strands onto a collapsible tube mounted on an appropriate mandrel. In a filament or strand winding or rewinding operation the tensioning of each filament or strand is necessary to build a tight package. Such a package does not have random loops or strand and will not collapse when unwound and will not produce ringers or whole layers or strands falling off the package at one time. This is important not only for the avoidance of waste, but also for the continuity and efficiency of the sundry processes in which glass fiber strands from such packages are used.

Various devices have been used to place tension on filaments and strands in winding or rewinding operations. These include passing the filaments or strands over a series of stationary or rotating bars or stationary discs. The bars, which are usually 50 to 75 millimeters in diameter, are typically offset so that strands travel between the bars at a determined wrap-around angle. This mode of strand travel applies friction to the strands. The disc tensioner usually has two hard chrome discs of the same diameter, where the bottom disc is fixed, and the top disc has a hole in its center through which passes a short, smooth, unglazed, ceramic rod. The top disc can slide on this ceramic rod. The strand passes through a slot in the rod so that it slides on the bottom disc. A retainer-spring assembly attached to the top disc applies pressure to the strand or strands. The bar and disc tensioner can be manufactured from such materials as chrome steel, unglazed ceramics and brass.

A rewinding operation for filamentary materials that is well known in the art in the twisting operation to produce filamentary yarn. Yarn is produced by twisting a single strand or by simultaneously twisting together several strands. The latter yarn product is usually referred to as plied yarns. Also, cabled yarns are formed by twisting two or more plied yarns together.

A description of a conventional yarn twisting operation is given at pages 268 through 272 of the book entitled "The Manufacturing Technology of Continuous Glass Fibers" by K. L. Loewenstein, Elsevior Scientific Publishing Company, New York, 1973. In such an operation and twisting is carried out by feeding the strand or yarns at a controlled rate to a bobbin placed on a spindle rotating at a speed which would enable the yarn or strand to be wound onto the bobbin at a rate considerably faster than the rate at which the strand is being supplied to the bobbin. In order to control the deposition of strand on the bobbin and the tightness of the strand layers on the bobbin, the strand is passed through a traveling eye located on a lubricated traveling ring. The ring itself is mounted in a frame which moves up and down by one or more program controlled cams. This movement governs the shape of the layers of yarns on the bobbin.

In producing yarns the principle of twisting the strands is based on the feed rate of the strand from the supply package being less than the rate at which the bobbin on the spindle can receive the strand. The resulting retardation causes the traveler to revolve around the ring and each revolution causes one twist.

In yarn production, tension in the strand being twisted and wound is produced primarily by the weight of the traveler. These travelers are usually made of nylon or steel. As the strand travels from the supply package to the traveler, it passes through a guide. When the strand travels between the guide and the traveler, the strand will balloon out to an extent depending on the tension provided by the traveler. Therefore, the weight of the traveler must be a proper weight to prohibit the ballooned strand from ballooning too far and contacting other parts of the twisting machine. Therefore, the production of yarn can be viewed as a winding operation to produce a tightly wound strand having a good configuration and confirmation and to place the strand on a large bobbin instead of a paper tube onto which it was initially wound and which is not suitable as a carrier for transporting the strand.

Yarns have applications in various products such as the reinforcement in adhesive paper tapes, and fine strand yarns used in high quality reinforcing cloths, such as those used for aircraft components and printed circuit boards. In some of these yarn applications, the twist in the yarn is not absolutely necessary. Even so, producers of yarns still produce the yarn with a twist for such applications, because it is a method of rewinding strand or strands from a supply package to produce a yarn package with good confirmation and configuration and with little trouble with fuzz, ringers or sloughing when the yarn is removed from the package. Producers of yarns have accepted the inefficiency of the low production rate per spindle in yarn processing to achieve the desired package build and form. Also, twisting in yarn processing for yarns not needing a twist continues because of the in place availability of the twisting machinery.

Although the continued use of a twisting operation to rewind filamentary material into yarn, where a twist in the yarn is not necessary has this inefficiency, it continues to be used in producing such yarns because no other satisfactory rewinding process is available to produce the same high quality package of yarn.

Any other rewinding process or apparatus, like the twisting operation, must produce a rewound package with little, if any, fuzzing, ringing or sloughing of the strand in the winding and unwinding process and must produce an excellent package with good confirmation and configuration which is creelable and shippable in minimum space. Also, rewinding without twisting has not been economically advantageous because of the availability of the in place twisting machinery, now, twisting machinery is becoming more expensive and this, combined with the noisy and slow mode of operation of twisting machinery, is providing a need for alternatives to twisting for rewinding and for winding in general. This need has not been fulfilled by the prior art.

It is an object of the present invention to provide a method and apparatus for controlling the tension of one or more strands during winding.

It is a further additional object of the present invention to provide a method and apparatus for controlling the tension of the strand in a rewinding process without additional twisting to produce a minimum twist yarn.

It is an additional further object of the present invention to provide a method and apparatus for controlling the tension of the strand or strands in rewinding the strand or strands to produce a package of minimum twist yarn wherein the package has a good build including tightness, and compaction, and has little or no loops of strands and little or no ringers and little or no sloughing and wherein the apparatus allows the method to be conducted at favorable processing speeds with production of quality strand yarn, and with efficiency of transfer from strand package to yarn package.

PRESENT INVENTION

The foregoing objects and other objects resulting from the teaching of the following disclosure are achieved by the method and apparatus of the present invention.

The method of the present invention is for controlling the tension of strand or strands of filamentary material during winding of the strand or strands by a rotating collecting means. The control of the tension is affected by conveying the one or more strands from a source to a rotating contacting means, having a drive means where the strand contacts the rotating contacting means, and driving the rotating contacting means to provide a drag to the strand, reciprocating the strand from one end to the other end of a rotating collecting means to collect the strand into a layered package. The driven rotating contacting means can be driven in a reverse direction to the direction of the strand travel to provide the drag to the strand or can be driven in the same direction as the direction of movement of the strand, but at a slower velocity than the velocity of the strand.

In conveying strand or strands that are untwisted or have only a minimum twist from the source to the rotating contacting means, the strand or strands are guided by a rotating contacting means that has an eccentric groove in the peripheral surface of the rotating contacting means. The grooved rotating contacting means with the drive means must be located at an effective distance from the package being built on the rotating collecting means. The effective distance is that which still allows an adequate throw of the strand from the grooved rotating means onto the rotating collecting means or the package being built thereon. The throw is the distance the strand moves from side to side as it is placed on the rotating collecting means or the package thereon caused by the angle of the groove across the periphery of the grooved rotating contacting means.

The apparatus of the present invention is also for controlling the tension of strand or strands of filamentary material during winding of the strand or strands by a rotating collecting means. The apparatus has a strand source mounted on a support and one or more strands are advanced from the strand source, a rotating contacting means receives the advancing strands from the source, a drive means for driving the rotating contacting means provides a frictional drag to the strand, and a rotating collection means having a drive means to provide constant velocity or uniform decreasing velocity receives the strand from the rotating contacting means to wrap or wind the strand or strands, and a means for moving the rotating contacting means and rotating collecting means relative to one another to reciprocatingly dispose the strand on the rotating collecting means in layer-by-layer fashion to produce a package of strand or strands. The drive means for the rotating contacting means may drive the rotating contacting means in a direction opposite to the direction of the strand travel or in the same direction as strand travel but at a slower velocity than the surface velocity of the strand. The rotating contacting means has an eccentric groove on the peripheral surface when used with untwisted or minimally twisted strand or strands.

BRIEF DESCRIPTION OF THE DRAWING

In FIG. 3 a single tapered end package is depicted.

DETAILED DESCRIPTION OF THE INVENTION

The filamentary material useful in the method and apparatus of the present invention can be any synthetic or natural filaments or strands. Nonexclusive examples include polyester, polyamide, glass fibers, asbestos, polyacrylonitrile, cellulose acetate, cotton, wool and the like. It is preferred to use the method and apparatus of the present invention with glass fiber strands. Any of these filamentary materials in the form of strands can be twisted or untwisted or have only a minimal twist which naturally occurs in removing strands from a package.

The method and apparatus of the present invention can be used in any type of winding operation for the filamentary materials, where it is desired to increase the strand tension during winding. For example, the winding operation can vary from winding of filaments to produce bundles of filaments or strands to rewinding strands to produce untwisted or minimal twist yarns to rewinding twisted strands or yarns.

Figure 1:
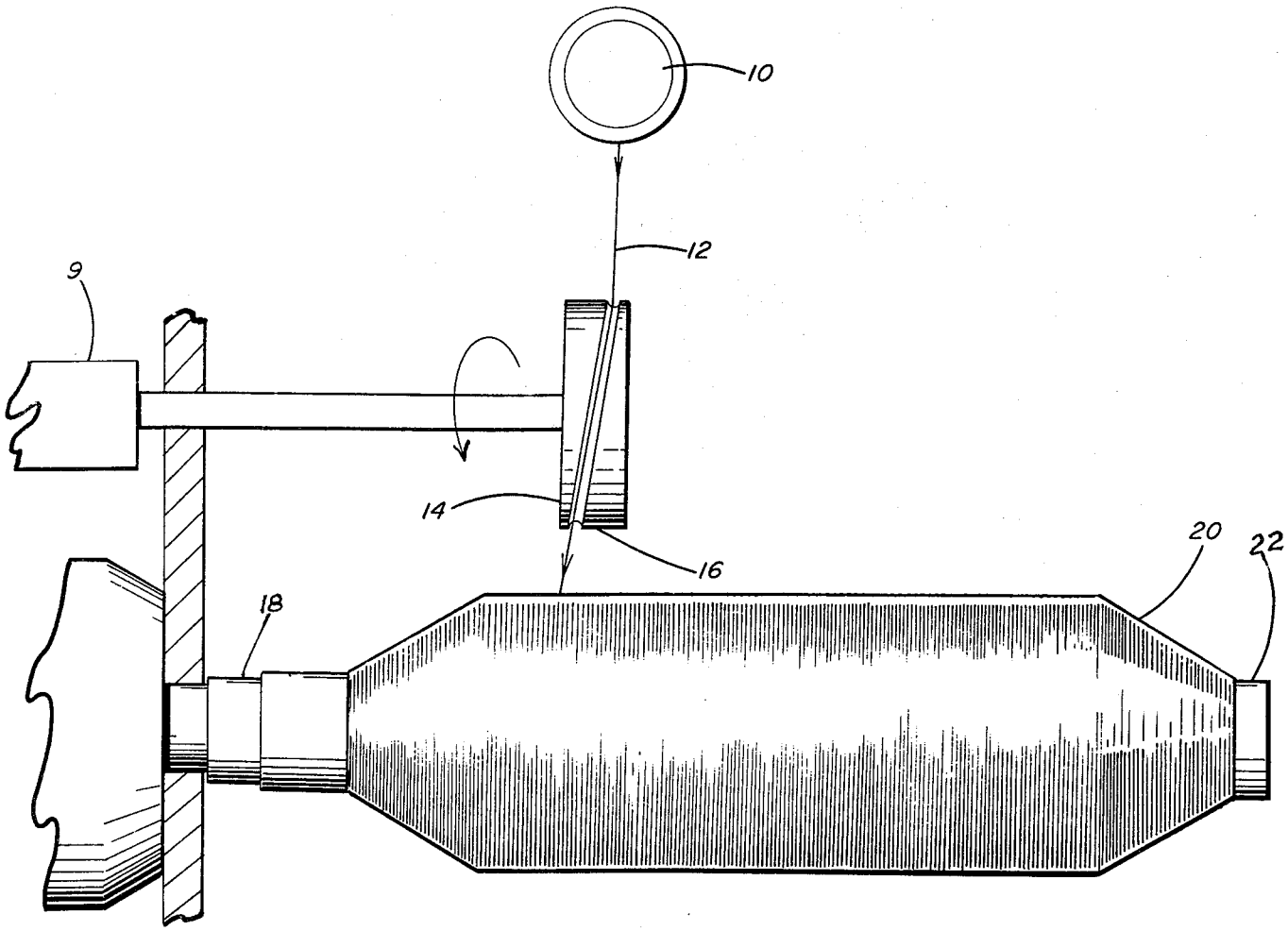
FIG. 1 PRIOR ART
FIG. 1 is a schematic of the prior art method and apparatus.

Turning now to FIG. 1 there is shown a prior art method of winding strand to produce a package of yarn.

The strand source 10 is a forming package for glass fiber strands. Strand 12, which for puposes of convenience is referred to in the singular as strand but can also be the plural strands, is removed from the strand source first manually and then afterwards by the winding motion of a winder. The strand is conveyed to a cam 14 which has groove 16 cut on a diagonal through the peripheral surface of the cam. The movement of the cam is caused also be the movement of the strand being pulled by the winder. The strand 12 leaves the grooved cam and is pulled to tube 22 and subsequently packaged. First on tube 22 the strand is wound in layer-by-layer fashion by traversing mechanism 9 to build up a package 20. Tube 22 is wound by being on a mandrel 18 which is the mandrel of a winder having a drive means to drive the mandrel to wind the strands into the package while the traversing mechanism 9 reciprocates the cam 14 to move the strand back and forth across the mandrel.

Figure 2:
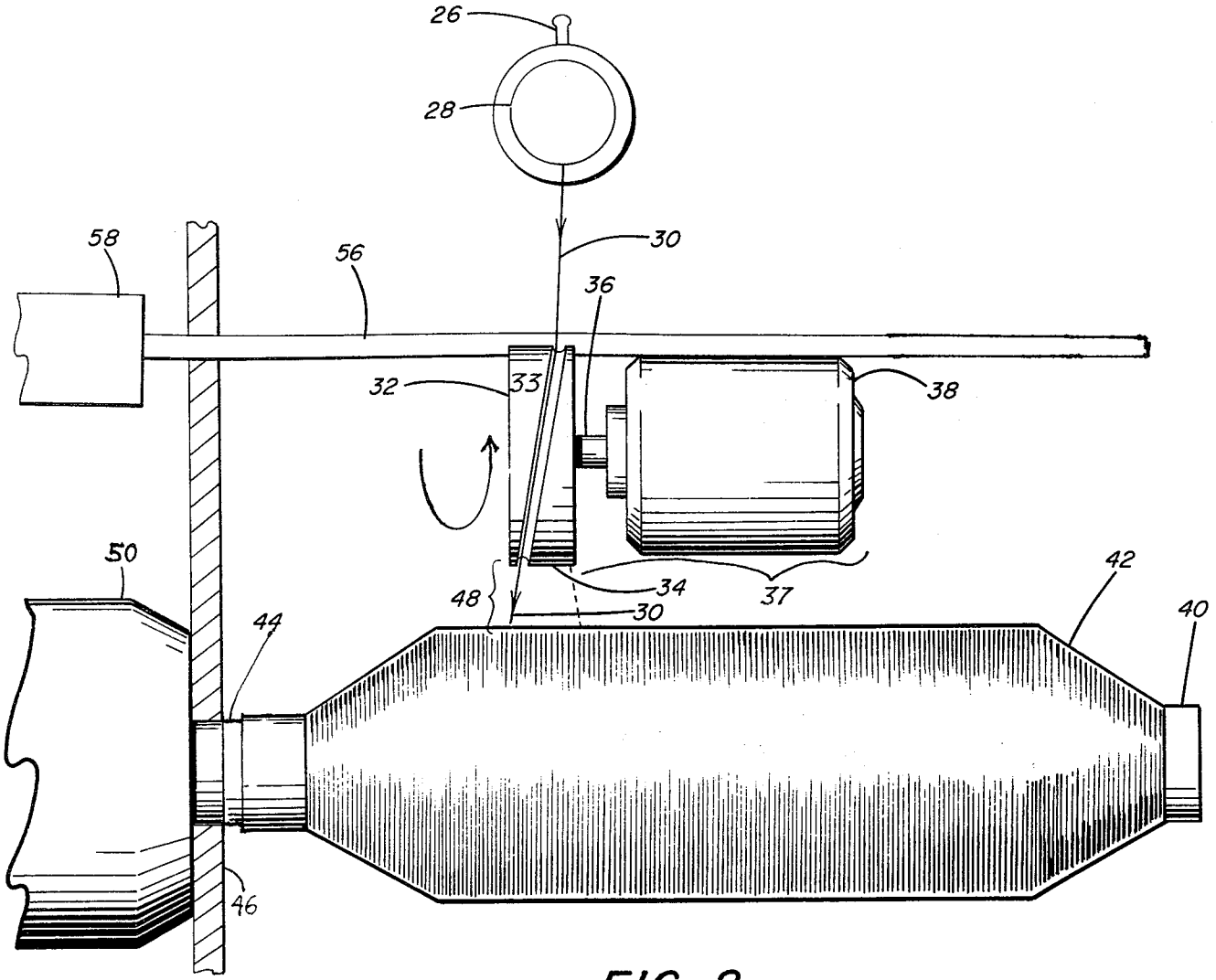
FIG. 2 is a schematic drawing of the present invention used in producing a package of yarn tapered at both ends, where the strand source, grooved and rotating contacting means with drive means, rotating collecting means are located vertically to each other. Also, the means for relative motion between the grooved rotating contacting means and rotating collecting means to reciprocate the strand is a traversing drive arrangement attached to the drive means for the grooved rotating contacting means.

Now referring to FIG. 2, strand is supplied from a strand source 28, which can be any source from which the strand is to be wound, where it is desirable to increase the tension of the strand during winding. The strand source is adequately supported by support 26.

The strand 30 is conveyed from the strand source 28 to a rotating contacting means 32. Nonexclusive examples of the rotating contacting means include cams, wheels, rolls, rods, and the like. It is preferred that the grooved rotating contacting means is a cam, which for convenience is hereafter referred to in the specification as a cam. The cam 32 can be constructed of any material such as Micarta® laminate nylon, polyester and thermosetting polymers such as urea and melamine formaldehyde and polyolefins like polyethylene, such as high density and ultra high molecular weight polyethylenes, and metals such as steel and even brass, and any type of ceramic material, especially those into which a groove can be cut.

When the strand is untwisted or has a minimal twist, the rotating contacting means, now referred to as a cam without limiting other types of contacting means, must have an eccentric groove in the peripheral surface of the cam in the direction of rotation of the rotating cam. The eccentric groove is a diagonally cut groove. For one complete rotation of the cam, the relationship between the groove and the axis of rotation of the cam is an acute angular relationship for approximately half the revolution and an oblique angular relationship for the remaining half of the revolution. This is shown in FIG. 2, where the groove at 34 runs diagonally across the curved surface 33 of one side of the cam. The groove 34 on the other curved surface opposite the curved surface shown in FIG. 2 is also diagonal across the curved surface, but the diagonal is in the opposite direction to the diagonal shown in FIG. 2. This diagonal groove in the opposite direction connects groove 34 at the bottom end of the cam 32 shown in FIG. 2 with the groove 34 at the top of cam 32. Therefore, the groove is cut into the peripheral surface of the cam 32 for its entire length.

The untwisted or minimally twisted strand, like strand 30, contacts the groove in the cam and travels in the groove during half of each revolution of the cam. The strand will travel in one direction, and then the other direction, depending on the place the strand first contacts the groove. This changing direction of travel of the strand is caused by the two different directions of the groove in cam 32. This change in direction of the strand causes the strand to be laid on the rotating collecting means 40 in a wavy, nonparallel fashion. This wavy pattern reduces strand looping, ringering, and sloughing when the strand is removed from the wound package of strand 42 wound on rotating collecting means 40. The depth of the groove in the peripheral surface is that sufficient to retain the moving strand for around one half of each revolution of the cam. Preferably, the depth of the groove is around 2 to around 6 times the width of the strand. For example, the depth of the groove can be about an eighth to a quarter of an inch for strand comprised of 200 filaments having a filament diameter of 9.14 microns.

When the strand is twisted, or by some other fashion held in an integral bundle like a twisted strand, the cam need not have a groove. In this case, the strand contacts the cam or rotating contacting means for any contact duration desirable by changing the length of the peripheral surface contacting the strand.

The cam 32 has an axis 36 attached to the center of the cam at one end and at the other end the axis 36 is attached to a drive means 38. The cam is mounted in a freely rotatable fashion on axis 36 or a freely rotatable axis 36 has cam 32 conveniently secured thereon. The drive means is any suitable constant or variable speed motor for rotating the cam. Also, the drive means could be a drive roll powered by a motor. The drive means drives the cam to provide controlled frictional drag to the strand as the strand contacts the cam or travels in the groove of the cam. The rotational speed at which the cam is driven depends on several factors. These include the type of strand and the material of which the cam is constructed. If the cam is constructed of a material that provides more drag to the strand or a higher coefficient of friction between the strand and cam, the drive means can drive the cam at slower velocities to achieve the same degree of tension. As can be appreciated, the converse is also true, i.e., if the cam is constructed of a material that provides less drag for the strand or a lower coefficient of friction (coe) between the strand and cam, the drive means can drive the cam at a faster velocity to achieve the same desired tension. This relationship also applies in the same way for the type of strand used and its effect on the drag or coe.

The drive means provides the drag or coe to the strand by driving the cam in the reverse direction to that of the strand travel or by driving the cam in the same direction but at a slower velocity than the surface velocity of the strand. When the cam is driven in a reverse direction to the direction of the strand, the velocity of the cam can be any velocity that is not detrimental to the strand. This will depend upon the particular type of strand or the polymeric coating or film present on the strand. The velocity of the cam in the same direction as the direction of the strand can be any velocity that is less than the surface velocity of the strand. This velocity depends on the degree of tension desired for a particular package build. A tighter package build will require more tension, which can be achieved by driving the cam at an even slower velocity relative to the surface velocity of the strand.

As the strand 30 leaves the driven cam, the strand traverses core 40 in a layer and then package 42 in a layer-by-layer fashion to be wound to form a package. Core 40 is present on the rotating collection means 44 having a drive means, not shown. The rotating collecting means with drive means provides the surface velocity for the strand to pull the strand from source 26 over cam 32 and onto and around core 40. The rotating collecting means can be any device known to those skilled in the art for winding filaments, strand or strands. Nonexclusive examples include: winders, like take-up winders, coner winders, twist frames and pneumofil bobbin winder. The rotating collecting means preferably is a winder for rewinding glass fiber strand from a forming package into a minimally twisted yarn package. The winder is driven in such a manner to provide near constant surface velocity for the strand. The driving means can be any known constant or variable speed motor. The winder has a shaft 44 on which core 40 is placed. Core 40 can be any hollow tube about which strand can be wrapped such as bobbins, tubes, sleeves and the like.

The strand in any form, that is twisted, minimally twisted or untwisted, traverses core 40 and subsequently traverses package 42 in a reciprocal manner. The reciprocating traversing can be effected by several approaches, the preferred one of which is illustrated in FIG. 2.

In the approach of FIG. 2, the unit 37 reciprocatingly traverses over core 40 and subsequently package 42 by traversing mechanism 58. The traversing mechanism 58 is attached to travel rod 56 in any manner to provide a reciprocating force along travel rod 56. Travel rod 56 is attached to motor 38 of unit 37 in a manner to translate the reciprocating force traveling along rod 56 to the unit 37. The unit 37 is then reciprocatingly traversed across core 40 and subsequently package 42 to place the strand on the core and package in a layer-by-layer fashion. The unit 37 comprises motor 38, axis 36 and cam 32. The traversing device 58 and traveler rod 56 can be any suitable traversing apparatus for moving unit 37 back and forth in a horizontal plane over core 40. One nonexclusive example of traversing device 58 and traveler rod 56 includes a continuous traveling track such as a chain having an extended member on pin as traveler rod 56, which engages a slot in a mounting on motor 38, and a reciprocating motor attached to one or more pulleys as traversing device 58. The chain is movably connected to the pulleys of traversing device 58. Another example, which is the preferred example, is to have traveler rod 56 as a lead screw where motor 38 has a suitable bracket for attachment thereto. Other examples for traveler rod 56 include cam drives and belt drives. With these drive devices for traveler rod 56, the traversing device 58 is a suitable motor with appropriate attachments for the various drives. The motor can be in fixed attachment to housing 46 for winder motor 50.

In addition to the aforedescribed approaches for providing the reciprocal traversing movement of the strand, other approaches may also be used. Another approach is to hold the unit 37 in fixed attachment to rod 56 and reciprocatingly traverse the rotating collecting means 44 with winder 50. This can be accomplished by any suitable reciprocating winder known to those skilled in the art. Another approach is to hold the rotating collecting means in a stationary horizontal location and also hold motor 38 in a stationary horizontal location to the extreme left or right above core 40. While holding these two elements stationary, axis 36 can be extended and retracted by means of axis 36 being a spline shaft. To the spline shaft there is movably attached the spline fitting which is secured to cam 32. In the operation of this approach, motor 38 mounted on frame 46 is energized conveniently for rotating the spline fitting and cam 32. Cam 32 can be moved along the spline shaft by any convenient method known in the art such as a carriage with a suitable ring and pinion device on a shaft to engage the cam and move it along the spline shaft. This movement is then reversed by any suitable apparatus and method known to those skilled in the art to produce the reciprocal traversing movement of cam 32. An example of this movement, the spline shaft and fitting and engaging apparatus are disclosed in commonly assigned U.S. patent application Ser. No. 153,283, filed May 27, 1980, now U.S. Pat. No. 4,331,273 which is incorporated herein by reference.

In addition to the reciprocal traversing movement relationship between the unit 37 and rotating collecting means 44, another relationship may exist between these two elements. This relationship exists when the strand being wound is minimally twisted strand. In this case, the cam 32 must be located an effective distance from the rotating collecting means to provide for the disposition of the untwisted strand onto the core 40 and package 42 in a wavy, unparallel fashion as hereinbefore described. This effective distance is at one extreme the close proximity of just allowing for the respective rotations of the cam and rotating collecting means. The other extreme that brackets the range of effective distance is a distance such that the wavy, unparallel pattern of the disposed strand does not have an amplitude less than the width of three parallel, abutting strands. For glass fiber strand, the effective distance is preferably in the range of about $\frac{1}{8}$ inch to $\frac{3}{4}$ inches.

With the cam being driven relative to strand travel direction in a reverse direction or in the same direction but with a slower velocity than the strand, the tension of the strand 30 between cam 32 and core 40 can be controlled. The control basically increase strand tension over the prior art process of FIG. 1. This increase in strand tension can be a near uniform tension if the cam is driven at a near uniform velocity, or the strand tension can be varied by varying the speed of the motor. This allows for myriad tensions being achieved on strand 30, resulting in a greater degree of control of the tension with reduced variability over prior art devices. The greater degree of control yields a package of strand or yarn on core 40 that has good conformation and configuration with little, if any ringers, sloughing or looping of the strands on the package or when removed from the package.

Figure 3:
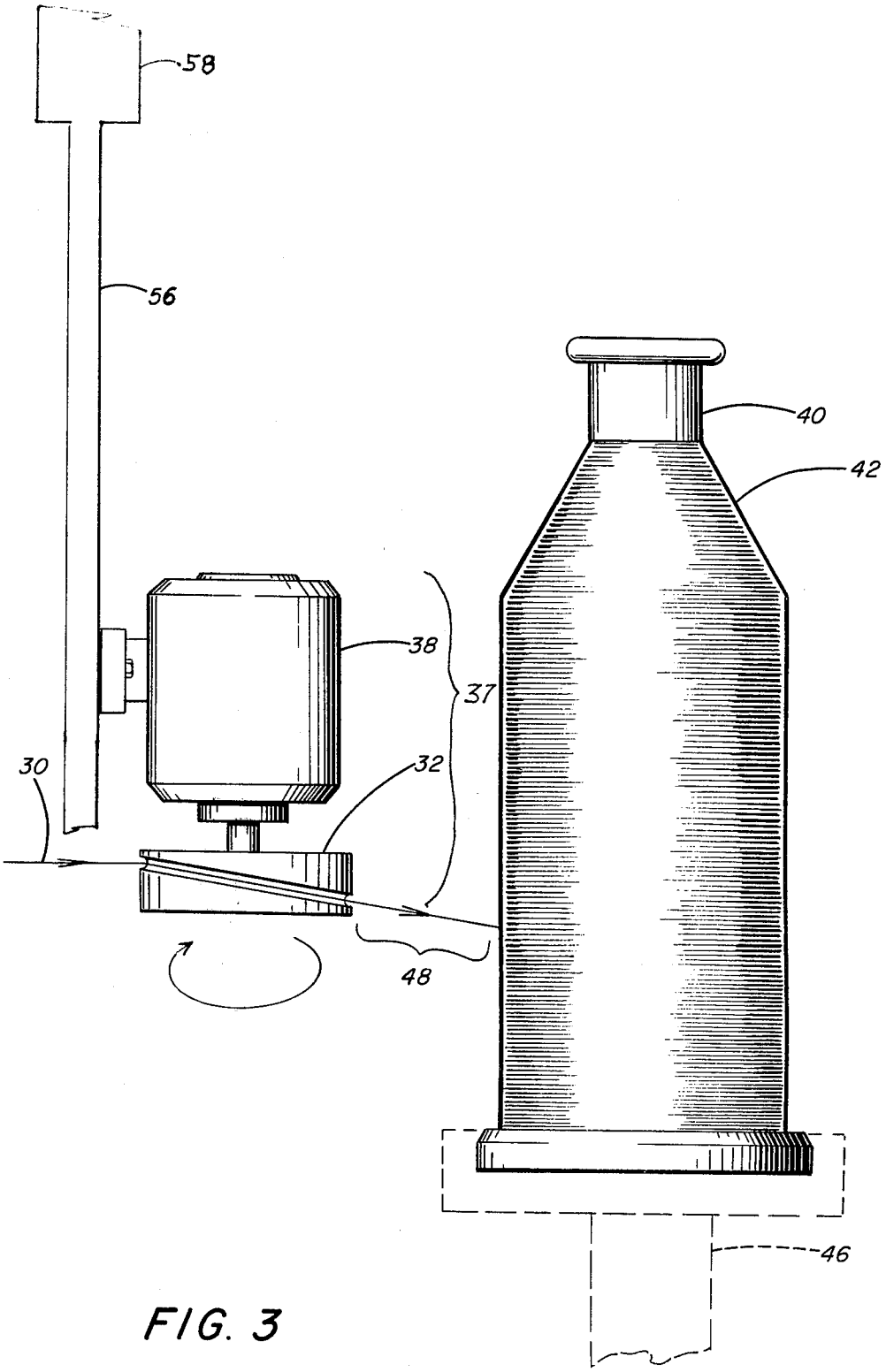
FIG. 3 is a schematic drawing of the present invention, where the strand source, grooved rotating contacting means with drive means and rotating collecting means are horizontally disposed. Also, the means for relative motion between the grooved rotating contacting means and rotating collecting means to reciprocate the strand is a traversing drive arrangement attached to the drive means for the grooved rotating contacting means.

The stroke of the traversing unit 37 or alternatives can travel the length of the rotating mandrel 44 of winder 50 during the building of the entire package. Also, the stroke can be shortened in either direction or in both directions to produce single or double taper packages, respectively. A double taper package is illustrated in FIG. 2 and a single taper package is illustrated in FIG. 3. The mandrel 44 is rotated at a constant speed by means of a drive belt pulley motor assembly (not shown). As the strand is accumulated on the mandrel 44, the speed of the mandrel is adjusted so that a constant peripheral speed is obtained on the surface of the strand wound on mandrel 44. This adjustment in winding is achieved by programming the speed of the motor (not shown) to adjust the depth of strand wound on mandrel 44.

Now referring to FIG. 3, the location of the rotating contacting means, i.e., grooved cam, is horizontally disposed in relation to package 42 which is now a single taper package. This disposition is different from FIG. 2 which has the drive means and rotating contacting means, cam, disposed vertically in relation to the package 42. The alignment of the travel rod 56 and traversing device 58 are also changed to accommodate the horizontal disposition of unit 37 to the rotating collecting means. Once again, the grooved cam 32 has a rotatable attachment to motor 38 which is movably attached to traversing rod 56 to enable reciprocal traversing movement of unit 37. Here, an example of the travel rod and traversing device is the bar support holding the ring and traveler of a standard twist frame and the mechanism of the twist frame for moving the ring and traveler up and down. The strand 30 contacts groove 34 and rotating cam 32 in the same manner as in FIG. 2. The strand traveling through the effective distance 48 is thrown onto the core 40 in a wavy, unparallel fashion for one layer and then accumulated layer on layer by the reciprocal traversing movement to produce package 42. Core 40 is rotatably connected to spindle 44 on winder 50 having a drive means (not shown). The operation of the horizontal alignment of the elements in FIG. 3 is in every respect the same as the operation of the vertical alignment of FIG. 2 except for the suitable placement of the elements to permit the operation in the horizontal alignment.

Figure 4B:
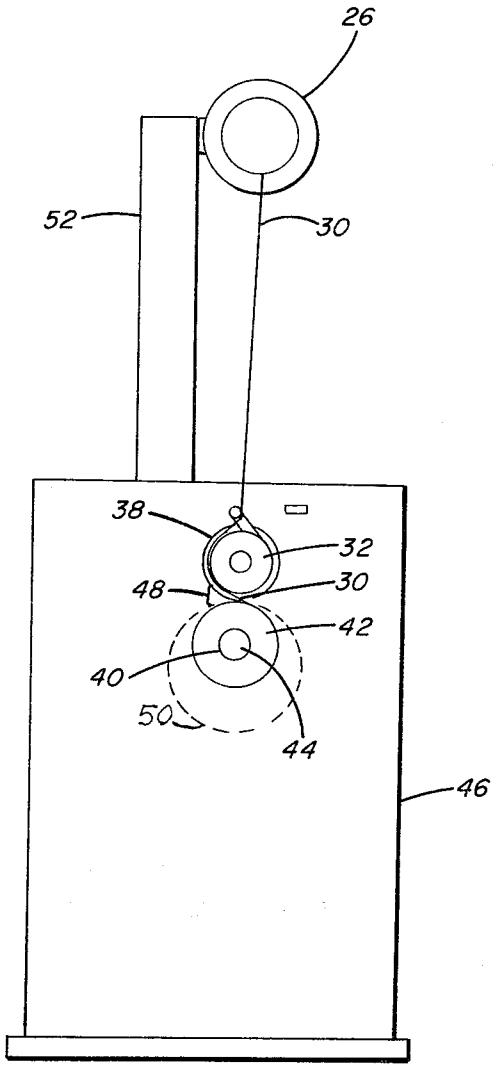
FIG. 4B is a schematic, frontal, partial cutaway view of the apparatus of the present invention with the elements of the apparatus vertically disposed.
Figure 4A:
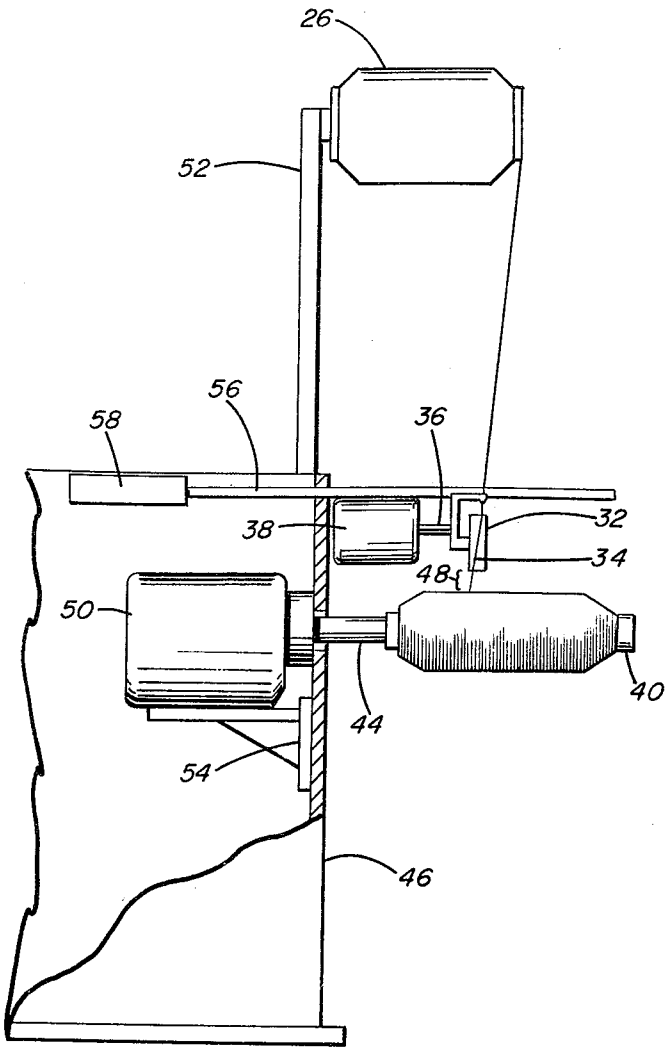
FIG. 4A is a schematic, side, partial cutaway view.

FIGS. 4A and 4B shows a side view and front view of the method and apparatus of the preferred embodiment of the present invention in winding minimally twisted glass fiber strand yarn. First, referring to FIG. 4A, the strand source 26 provides strand 30 which is conveyed to cam 32 having a rotatable attachment to axis 36 which is connected to drive means 38. The strand 30 travels for guidance in groove 34 of cam 32 then through the effective distance 48 to core 40 on mandrel 44. Mandrel 44 is rotating by means of winder motor 50 to wind the strand into a layer on the core. Additional strand is accumulated layer-by-layer on top of the previously accumulated layer by the reciprocal traversing movement of unit 37 along travel rod 56 powered by traversing mechanism 58. Once again, the mode of operation of grooved cam 32, axis 36, motor 38, travel rod 56 and traversing device 58 are the same as that described in FIG. 2 for preferred operation as is the mode of operation of the winder and mandrel. The strand source 26 is supported by support member 52 which is preferably attached to winder 46. The motor 50 in winder housing 46 is attached to the winder by attachment member 54 and the traversing means 58 for traversing the grooved cam is attached preferably to the housing 46 of winder.

In FIG. 4B there is a front view of the same apparatus shown in a side view in FIG. 4A. Here the strand source is once again located above the rotating contacting means with drive means as it was in FIG. 4A. Although it is also within the scope of the invention to have the strand source located directly or indirectly beneath the rotating contacting means having a drive means where the strand is fed to the rotating contacting means by a system of pulleys. The strand source is supported by support member 52 which is preferably attached to winder housing 46. The strand 30 travels vertically to the rotating contacting means, cam 32, which has the drive means 38 to which the cam is rotatably attached by axis 36. The strand 30 travels in groove 34 (not shown in this view) and travels through the effective distance 48 to core 40 located on mandrel 44. A layer of strand is accumulated on the core and successive layers of strand are accumulated one on top of the other to produce package 42. The motor 38 is shown as it is located behind cam 32 to which the cam is attached for reciprocal traversing movement by motor 38 being movably attached to travel rod 56. Travel rod 56 is connected to a traversing means (not shown in FIG. 4B) which is behind the housing 46 of the winder. Here the mandrel is shown attached to winder 50, which is behind housing 46. Once again the mode of operation of the grooved cam with drive means, winder and travel rod 56 and traversing mechanism can be the same as those shown in FIG. 2.

The process and apparatus depicted in the drawings is obviously subject to many variables. Thus, while only one strand 30 is shown in the drawing as being wound on the mandrel 44, this is solely for illustrative purposes. The strand may be multiple strands or even a twisted strand or twisted strands.

An advantage of having the rotating contacting means with a drive means for use in winding filaments, bundles of filaments, strand or strands in twisted or untwisted condition is to control the tension of the strand that is wound into a layer upon layer package. The control of the tension enables the production of a package of accumulated filaments, bundles of filaments, strand or strands which has good configuration and confirmation with little or no ringers, sloughing and looping of the material being wound.

We claim:

1. A method of controlling strand tension during winding of filamentary material from a source, comprising:

a. contacting the filamentary material from the source with a rotating contacting means having an eccentric groove on the peripheral surface of said contacting means and having a drive means so that the filamentary material contacts the groove of the contacting means, b. driving the rotating contacting means in a reverse direction to the direction of movement of the filamentary material to provide a draw to the filamentary material contacting the groove, c. reciprocatingly traversing the filamentary material leaving the rotating contacting means, d. collecting the reciprocating filamentary material directly from the rotating contacting means onto a rotating collecting means having a drive means which pulls the filamentary material from the source into contact with the groove of the rotating contcting means so that the filamentary material is guided onto the rotating collecting means that is located at an effective distance from the grooved rotating contacting means to provide a nonparallel disposition of the filamentary material onto the rotating collecting means to produce a layered package of strand where every layer has the filamentary material in a nonparallel disposition.

2. Method of claim 1 wherein the rotating collecting means is a winder.

3. Method of claim 1 wherein the filamentary material is glass fiber strand for producing minimum twist yarn having present only a twist for removing the strand from the strand source.

4. Method of claim 1 wherein the grooved rotating contacting means is a grooved cam positioned in vertical alignment with the rotating collecting means.

5. Method of claim 1 wherein the grooved rotating contacting means is a grooved cam positioned in horizontal alignment with the rotating collecting means.

6. Method of claim 4 or 5 wherein the drive means is a motor to which the grooved cam has a rotatable attachment.

7. Method of claim 1, wherein the filamentary material is untwisted or minimally twisted.

8. Method of claim 1, wherein the filamentary material contacts the eccentric groove of the rotating contacting means so that the filamentary material travels in the groove during half of each revolution of the rotating contacting means.

9. Method of claim 1, wherein the nonparallel pattern of disposition of the filamentary material onto the rotating collecting means is a wavy pattern having an amplitude not less than the width of three parallel abutting segments of filamentary material.

10. A method of controlling strand tension during rewinding of glass fiber strand from a forming package to a bobbin, comprising:

a. contacting the strand from the forming package to a rotating contacting means having an eccentric groove on the peripheral surface of said means and having a drive means to rotate the contacting means where the strand travels in the groove in the same direction as the direction in which the strand first contacted the rotating contacting means but where the direction varies due to the eccentricity of the groove, b. driving the eccentrically grooved rotating contacting means in a reverse direction to the direction of strand travel to provide a drag to the strand as the strand travels in the eccentrically grooved rotating contacting means, c. reciprocatingly traversing the strand traveling from the rotating contacting means, d. collecting the reciprocating strand directly from the rotating contacting means onto a winder shaft where the winder shaft is rotated by a drive means and where the winder shaft is located at an effective distance from the eccentrically grooved rotating contacting means to provide for nonparallel disposition of the strand on the winder to produce a layered package of strand with the nonparallel strand disposition in every layer of the package.

11. Method of claim 10 wherein the eccentrically grooved rotating contacting means is a cam.

12. Method of claim 10 wherein the strand is reciprocatingly traversed by the eccentrically grooved rotating contacting means traversing in reciprocal movement from one end of the winder shaft to the other end.

13. Method of claim 10 wherein the strand is reciprocatingly traversed from one end of the winder shaft to the other end by traversing the rotating contacting means and the drive means for the rotating contacting means.

14. Method of claim 10, wherein the strand is twisted or minimally twisted.

15. Method of claim 10, wherein the strand contacts the eccentric groove of the rotating contacting means so that the strand travels in the groove during half of each revolution of the rotating contacting means.

16. Method of claim 10, wherein the nonparallel pattern of disposition of the strands onto the rotating collecting means is a wavy pattern having an amplitude not less than the width of three parallel abutting strands.

17. An apparatus for rewinding filamentary material from a forming package to a shipping package to control the tension of the strand during winding of the strand onto the shipping package, comprising:

a. a support, b. at least one forming package of filamentary strand mounted on the support from which the strand is advanced, c. rotatable contacting means having an eccentric groove on the peripheral surface of said contacting means for receiving the advancing strand from at least one forming package, wherein the strand contacts the rotatable contacting means through the eccentric groove, d. drive means with rotatable attachment to the eccentrically grooved rotatable contacting means for driving the rotatable contacting means in a reverse direction to the direction of strand travel to provide drag to the strand contacting the rotatable contacting means, e. rotatable collecting means for receiving the strand from the rotatable contacting means and for pulling the strand from at least one forming package for contacting the rotatable contacting means through the eccentric groove of the rotatable contacting means and for winding the strand where the rotatable collecting means is an effective distance from the rotatable contacting means to allow for nonparallel disposition of the strand from the eccentrically grooved rotatable contacting means onto the rotatable collecting means, f. means for moving the rotatable contacting means and rotatable collecting means relative to one another to reciprocatingly traverse the strand across the rotatable collecting means to provide a layer by layer accumulation of strand on the rotatable collecting means to produce a package of strand.

18. Apparatus of claim 17 wherein the grooved rotatable contacting means is a grooved cam.

19. Apparatus of claim 17 wherein the rotatable collecting means is a winder mandrel.

20. Apparatus of claim 17 wherein the rotatable collecting means is a winder spindle.

21. Apparatus of claim 17, wherein the effective distance is in the range of about $\frac{1}{8}$ to about $\frac{3}{4}$ of an inch.

22. Apparatus of claim 17, wherein the eccentric groove in the periphery of the rotatable contacting means is comprised of two diagonal grooves each encompassing opposite halves of the circumferential peripheral surface.

23. Apparatus of claim 17, wherein the eccentric groove has a depth of around 2 to around 6 times the width of the strand contacted by the groove.

* * * * *

UNITED STATES PATENT AND TRADEMARK OFFICE

CERTIFICATE OF CORRECTION

PATENT NO. : 4,403,744

DATED : September 13, 1983

INVENTOR(S) : Walter J. Reese and Jimmy D. Walker

It is certified that error appears in the above-identified patent and that said Letters Patent is hereby corrected as shown below:

Column 10, line 35, delete the term "draw" and insert therefor --drag--; line 44, delete the term "contcting" and insert the term -- contacting --.

Column 11, line 14, delete the term "to" and insert therefor --with--.

Signed and Sealed this

*Fourteenth* Day of *February 1984*

[SEAL]

*Attest:*

GERALD J. MOSSINGHOFF

*Attesting Officer*

*Commissioner of Patents and Trademarks*